US007002563B2

(12) United States Patent
Nakamura

(10) Patent No.: US 7,002,563 B2
(45) Date of Patent: Feb. 21, 2006

(54) DRIVING METHOD FOR FLAT-PANEL DISPLAY DEVICE

(75) Inventor: Norio Nakamura, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 219 days.

(21) Appl. No.: 10/066,565

(22) Filed: Feb. 6, 2002

(65) Prior Publication Data

US 2002/0135574 A1 Sep. 26, 2002

(30) Foreign Application Priority Data

Feb. 7, 2001 (JP) ..... 2001-030612

(51) Int. Cl.
*G09G 5/00* (2006.01)

(52) U.S. Cl. ..... 345/204; 345/98

(58) Field of Classification Search ..... 345/87–104, 345/204, 209

See application file for complete search history.

(56) References Cited

U.S. PATENT DOCUMENTS

| | | | | |
|---|---|---|---|---|
| 5,192,945 | A * | 3/1993 | Kusada | 345/88 |
| 5,469,164 | A * | 11/1995 | Kemp | 341/145 |
| 5,614,922 | A * | 3/1997 | Kawaguchi et al. | 345/89 |
| 5,657,039 | A * | 8/1997 | Mizukata et al. | 345/95 |
| 5,905,484 | A * | 5/1999 | Verhulst | 345/98 |
| 5,959,600 | A * | 9/1999 | Uchino et al. | 345/94 |
| 6,072,456 | A * | 6/2000 | Karube et al. | 345/98 |
| 6,271,783 | B1 * | 8/2001 | Cairns et al. | 341/144 |
| 6,304,242 | B1 * | 10/2001 | Onda | 345/99 |
| 6,307,532 | B1 * | 10/2001 | Aoki | 345/94 |
| 6,462,725 | B1 * | 10/2002 | Orisaka | 345/98 |
| 6,633,284 | B1 * | 10/2003 | Hanari | 345/96 |
| 6,919,870 | B1 * | 7/2005 | Fukuda | 345/90 |
| 2002/0041263 | A1 * | 4/2002 | Aoki | 345/55 |
| 2002/0047840 | A1 * | 4/2002 | Fukuda | 345/212 |
| 2002/0105492 | A1 * | 8/2002 | Kosaka | 345/89 |
| 2002/0149558 | A1 * | 10/2002 | Kashima et al. | 345/100 |

FOREIGN PATENT DOCUMENTS

| | | |
|---|---|---|
| JP | 6-167952 | 6/1994 |
| JP | 7-295520 | 10/1995 |
| JP | 8-179364 | 7/1996 |
| JP | 10-97224 | 4/1998 |
| JP | 10-153761 | 6/1998 |
| JP | 411153984 A * | 6/1999 |
| JP | 3080053 | 6/2000 |
| JP | 3080054 | 6/2000 |

* cited by examiner

*Primary Examiner*—Amare Megistu
(74) *Attorney, Agent, or Firm*—Oblon, Spivak, McClelland, Maier & Neustadt, P.C.

(57) ABSTRACT

A driving method is used for a flat-panel display device which includes a plurality of signal lines, a plurality of gate lines substantially perpendicular to the signal lines, a plurality of switching elements provided near intersections of the signal lines and the gate lines, a plurality of pixel electrodes connected via the switching elements, and a counter electrode opposed to the pixel electrodes, and in which a display signal is sequentially supplied to the signal lines and a potential of the counter electrode is inverted with respect to a reference potential for every predetermined number of horizontal and vertical scanning periods or vertical scanning periods so as to perform a display operation. The driving method comprises fixing all the signal lines to a predetermined potential and inverting the potential of the counter electrode during a horizontal or vertical blanking period subsequent to a horizontal or vertical display period.

6 Claims, 8 Drawing Sheets

DRIVING METHOD FOR FLAT-PANEL DISPLAY DEVICE

This application is based upon and claims the benefit of priority from the prior Japanese Patent Application No. 2001-030612, filed Feb. 7, 2001, the entire contents of which are incorporated herein by reference.

BACKGROUND OF THE INVENTION

1. Field of the Invention

The present invention relates to a method for driving a flat-panel display device with the potential of a counter electrode to be inverted with respect to a reference potential.

2. Description of the Related Art

In general, in a liquid crystal display device, to prevent degradation of the characteristics of its liquid crystal layer, the polarity of a voltage applied across the liquid crystal layer is inverted periodically. The method of inverting the polarity of the liquid crystal application voltage for every predetermined number of frames is called "frame inversion driving". Actually, however, flicker is caused due to asymmetry of the voltage between the positive and negative polarities. As a driving method capable of reducing the flicker, "H-line inversion driving" and "HV inversion driving" are known. In the H-line inversion driving method, the polarity of the liquid crystal application voltage is inverted for every one or more predetermined gate lines (rows). In the HV inversion driving method, the polarity of the liquid crystal application voltage is inverted for every pixel. During the H-line inversion driving or HV inversion driving method, the potential of each signal line is switched for every predetermined number of horizontal lines to a polarity positive or negative to the potential of the counter electrode, so as to invert the polarity of the liquid crystal application voltage. Assume that switching is performed for each horizontal line, for example. During one frame, signals of a polarity positive to the potential of the counter electrode are written into pixel electrodes assigned to the odd-numbered gate lines, and signals of a polarity negative to the potential of the counter electrode are written into pixel electrodes assigned to the even-numbered gate lines. During the next frame, signals of a polarity negative to the potential of the counter electrode are written into the pixel electrodes assigned to the odd-numbered gate lines, and signals of a polarity positive to the potential of the counter electrode are written into the pixel electrodes assigned to the even-numbered gate lines.

With above-mentioned methods, the polarity of the liquid crystal application voltage is inverted, and this enables reduction of flicker to be observed on the screen due to the characteristics or imperfections of pixels.

In general, a voltage of about 4V is required for driving a liquid crystal. Therefore, when the potential of the counter electrode is fixed to perform the above-mentioned polarity inversion driving method, a dynamic range of 8V and accuracy in the voltage of each polarity are required for the output of the driving circuit. This causes a problem such as an increase in the consumption of power.

In contrast, if the polarity of the counter electrode potential is simultaneously inverted to decrease the output range of the driving circuit, the power consumption can be reduced accordingly and the voltage amplitude on the video bus can also be reduced.

FIG. 11 is a timing chart for operation timings of various components obtained in a (1H/common inversion driving) case where the counter electrode potential is inverted for every horizontal line while the H-line inversion driving method is performed using one-point-at-a-time scanning. In FIG. 11, a display signal voltage on a display signal bus, a control signal (shift pulse) SPj input to a j-th analog switch ASWj, a j-th signal line potential VSj, and the counter electrode potential Vcom are arranged from top down. As shown in FIG. 11, the counter electrode potential Vcom is inverted with respect to the half value of the maximum amplitude of the signal line potential to have the maximum and minimum levels of 5V and 0V. Assume here that the liquid crystal application voltage is regarded as being of a positive polarity when the counter electrode potential Vcom is set at the minimum level, and of a negative polarity when the counter electrode potential Vcom is set at the maximum level. When the normally white display mode is used, the signal line potential of the positive polarity is set at 0.5V for providing a display state of white and at 4V for providing a display state of black, whereas the signal line potential of the negative polarity is set at 4.5V for providing a display state of white and at 1V for providing a display state of black. In this display device, transition of each signal line potential becomes to the maximum, for example when both of two adjacent horizontal lines are set into the display state of black. In this case, it is expected that the signal line potential varies from 4V to 1V, and the maximum transition becomes to 3V.

Actually, however, the counter electrode potential is inverted while the signal lines are in a floating state. Therefore, the potential of each signal line varies with the potential of the counter electrode due to coupling between the counter electrode and the signal line. As a result, the signal line potential is shifted by +5V in accordance with the counter electrode potential, and reaches 9V. The signal line holds 9V until the next display signal is written thereto. In this state, if a signal line potential of 1V is written to set two adjacent horizontal lines at the black level, the signal line potential shifts at a variation range of 8V due to the inversion of the counter electrode potential.

As described above, in the case where H/common inversion driving is performed in the conventional liquid crystal display device, a variation in potential occurs in each signal line when the counter electrode potential is inverted for each predetermined horizontal line and frame, which increases the variation range of the signal line potential for the next writing operation. For example, the closer to black the display color of display pixels adjacent in a row direction, the greater the variation of the signal line potential and hence the higher the possibility of a defective display by the influence of the potential variation in each signal line.

BRIEF SUMMARY OF THE INVENTION

The present invention has been developed in light of the above problem, and aims to provide a driving method for a flat-panel display device, which can suppress variation in the potential of each signal line.

The present invention provides a driving method for a flat-panel display device which includes a plurality of signal lines, a plurality of gate lines substantially perpendicular to the signal lines, a plurality of switching elements provided near intersections of the signal lines and the gate lines, a plurality of pixel electrodes connected via the switching elements, and a counter electrode opposed to the pixel electrodes, and in which a display signal is sequentially supplied to the signal lines and a potential of the counter electrode is inverted with respect to a reference potential for every predetermined number of horizontal and vertical scanning periods or for every predetermined number of vertical scanning periods so as to perform a display operation, the driving method being characterized by comprising fixing all the signal lines to a predetermined potential and inverting the potential of the counter electrode during a horizontal or vertical blanking period subsequent to a horizontal or vertical display period.

According to the present invention, the potential of each signal line can be suppressed from varying upon inversion of the counter electrode potential. Further, the consumption of power can be reduced. In addition, the variation range in the potential of each signal line can be reduced, and hence suppress the occurrence of a defective display due to the potential variations of the signal lines.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A liquid crystal display device according to an embodiment of the present invention will be described with reference to the accompanying drawings.

The liquid crystal display device 1 comprises a liquid crystal panel LCP having a structure in which a liquid crystal layer is held and sealed between an array substrate and a counter substrate opposed thereto, and a display circuit for driving the liquid crystal panel LCP.

The array substrate comprises a pixel array section which includes signal lines Sj and gate lines Gi arranged on a transparent insulation plate made of, for example, glass and serves as a display area; a signal line driving circuit 20 for driving each signal line Sj; and a gate line driving circuit 10 for driving each gate line Gi. These components are integrally formed with the transparent insulation plate. Further, in the counter substrate, a light-shielding layer, a color filter layer and a counter electrode are provided on a transparent insulation plate. The liquid crystal panel is constructed such that the pixel array section and counter electrode face each other, and the liquid crystal layer is held between the substrates.

The display circuit includes a controller section CTL which receives a digital display signal DATA, a clock CLK, a synchronization signal ENAB or the like supplied from an external signal source S such as a personal computer, and performs a digital processing of generating control signals (such as a reset signal) for driving the liquid crystal display panel LCP, rearrangement of the digital display signal DATA, or the like. The display circuit also includes a D/A converter DAC for converting the digital display signal DATA into an analog form; a common circuit for outputting a counter electrode potential; and a DC/DC converter DC/DC for generating, from a power source potential VDD from the signal source S, various power source potentials required for driving the liquid crystal panel LCP. The controller section CTL, common circuit and DC/DC converter DC/DC are provided on a printed circuit board PCB, while the D/A converter DAC is provided as an IC mounted on a flexible printed circuit FPC. The display circuit and liquid crystal display panel LCP are electrically connected via the flexible printed circuit FPC.

Figure 1:
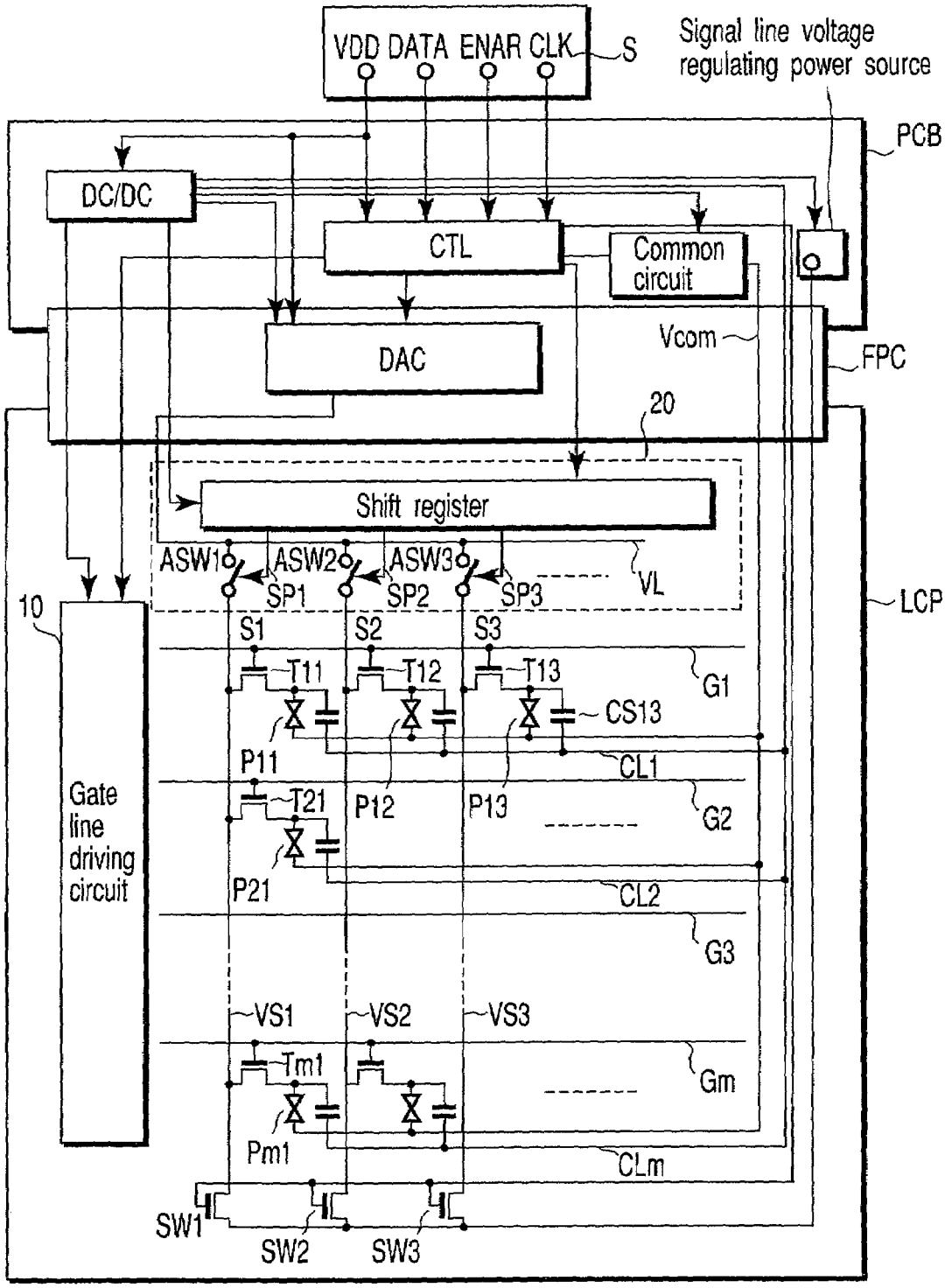
FIG. 1 is a plan view schematically illustrating the configuration of a liquid crystal display device according to an embodiment of the invention.

FIG. 1 is a view schematically showing the configuration of the liquid crystal display device 1. As shown in FIG. 1, a plurality of liquid crystal display pixels Pij (i=1, 2, . . . , m; j=1, 2, . . . , n) are arranged in a matrix on the liquid crystal display panel, each liquid crystal display pixel Pij being connected to a pixel TFT (Thin Film Transistor) Tij. The gates of pixel TFTs arranged in each row are commonly connected to a corresponding gate line Gi, while the drains of pixel TFTs arranged in each column are commonly connected to a corresponding signal line Sj. Further, each liquid crystal display pixel Pij is formed of a pixel electrode connected to a corresponding pixel TFT Tij, the counter electrode opposed to the pixel electrode and connected to the common circuit commonly provided for all the liquid crystal display pixels Pij; and the liquid crystal layer held between the pixel electrode and counter electrode. Storage capacitances CSij parallel to the liquid crystal display pixels Pij are connected to the pixel TFTs Tij. The storage capacitances CSij arranged in each row are commonly connected to a corresponding storage capacitance line CLi.

The gate line driving circuit 10 includes a shift register, and is arranged to sequentially output a row-scanning signal to the gate lines Gi on the basis of a vertical synchronization signal and vertical clock signal.

The signal line driving circuit 20 includes a shift register and analog switches ASWj, and is arranged to perform serial-parallel conversion of an analog display signal input from the display circuit on the external substrate, thereby outputting data on a display signal bus VL to a corresponding signal line.

Each signal line Sj has a switching element SWj at its end, the switching element having its drain commonly connected to a signal line voltage regulating power source and its gate connected to a reset terminal.

A description will now be given of a method for driving the liquid crystal display panel of the aforementioned circuit structure with a use of one-point-at-a-time scanning. The H/common inversion driving method is employed in this embodiment, thus the potential of the counter electrode is inverted for every predetermined number of horizontal periods. Specifically, the liquid crystal application voltage is inverted for every predetermined horizontal line and for every frame period. In addition, the polarity of the counter electrode potential is concurrently inverted for every horizontal line.

Assume that one horizontal display period is the period from the start of writing to an initially selected signal line, to the end of writing to a lastly selected signal line. More specifically, assume here that the one horizontal display period is the period from a time that a shift pulse SP1 for turning on the first-column analog switch ASW1 of each horizontal line has been supplied, to the time that a shift pulse SPn for turning off the last-column analog switch ASWn of each horizontal line has been supplied, and that a horizontal blanking period is the period from the end of one horizontal display period to the start of the next one horizontal display period. In other words, one horizontal scanning period is formed of the horizontal display period and horizontal blanking period.

Accordingly, the polarity of the signal line potential is inverted along with that of the counter electrode potential during the horizontal blanking period. This will be described in detail.

Figure 2:
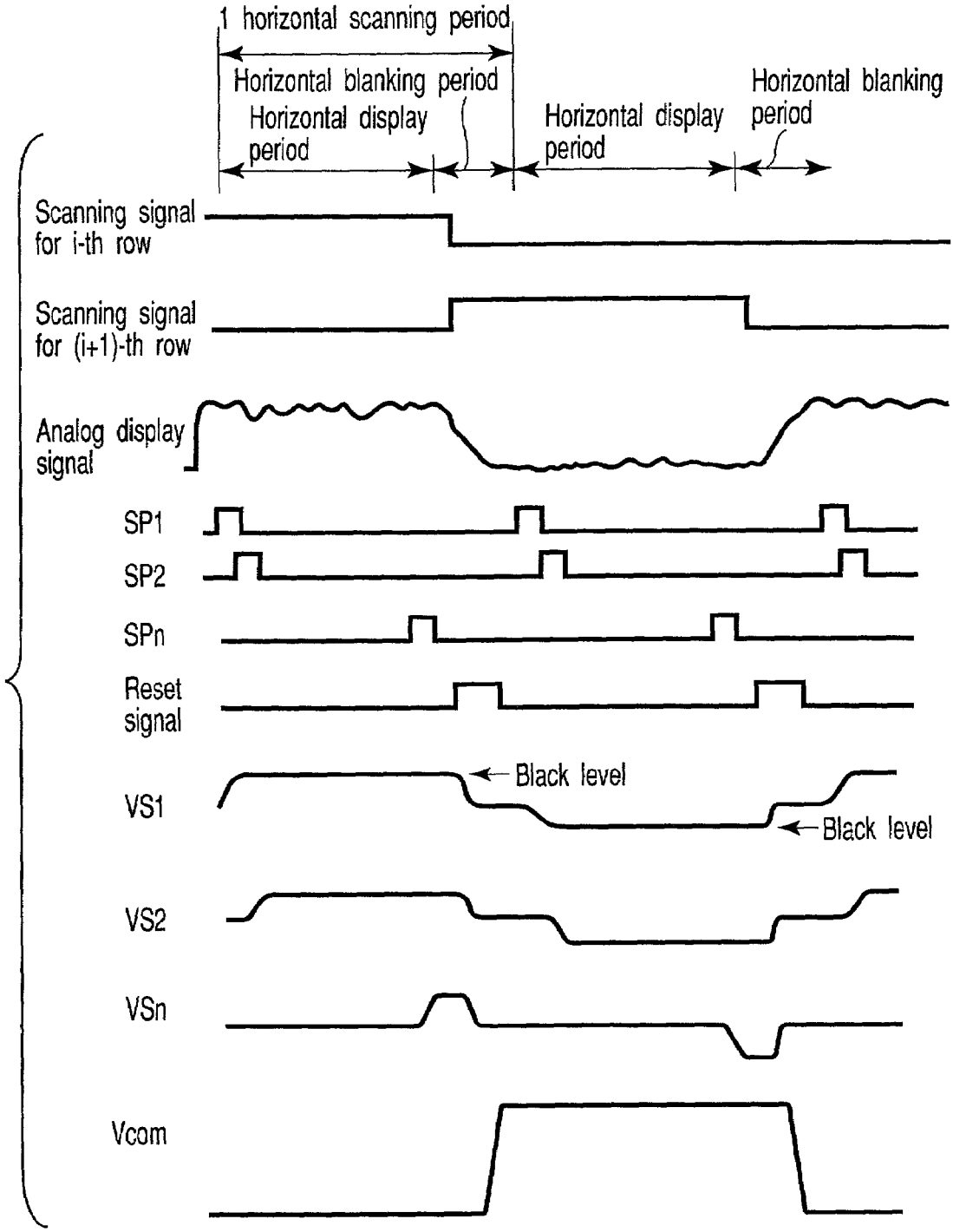
FIG. 2 is a timing chart illustrating the operation of the liquid crystal display device shown in FIG. 1.

FIG. 2 is a timing chart illustrating the operation of the liquid crystal display device. In FIG. 2, a scanning signal for the i-th row, a scanning signal for the (i+1)-th row, an analog display signal, a shift pulse SPj input to an analog switch ASWj of the j-th stage, a reset signal input to the gate of a switching element, a signal line potential for the j-th column, and the counter electrode potential Vcom are arranged from top down.

When a start pulse has been input at a certain timing, a necessary number of registers assigned to the signal lines sequentially output a shift pulse SPj obtained by shifting the start pulse in synchronism with a shift clock. The shift pulse SPj output from each register is input to the control terminal of a corresponding analog switch ASWj. When the shift pulse SPj has been input to the control terminal, the analog switch ASWj is turned on (closed), thereby supplying an analog display signal on the display signal bus VL to a corresponding signal line Sj.

As the above operation is repeated, each analog switch ASWj is turned on substantially at the same time that the shift pulse SPj is output from a corresponding register, thereby supplying a corresponding analog signal on the display signal bus VL to a signal line Sj connected to the analog switch ASWj.

As shown in FIG. 2, each signal line Sj holds a potential written immediately before the turn-off of a corresponding analog switch ASWj.

When a shift pulse SPn has been output from the last-stage register, a reset signal is supplied to the reset terminals of the switching elements SWj for fixing the signal line potential. As a result, the switching elements SWj are turned ON while all the analog switches ASWj are in the OFF state, whereby the potential of each signal line is fixed to a desired potential output from the signal line voltage regulating power source during each horizontal blanking period. Further, in synchronism with this timing, the counter electrode potential Vcom is inverted with respect to that in the preceding horizontal display period.

Since the pixel TFTs of a corresponding row are turned off by means of a scanning signal before the reset signal is input, the liquid crystal application voltage is maintained at a desired value based on a display signal.

After the horizontal blanking period finishes, a start pulse is input again and the registers of the shift register resume their shifting operations for the start pulse.

As described above, since all the signal lines are fixed to a desired potential, e.g. an intermediate potential in this embodiment, during the horizontal blanking period, variation in the potential of each signal line, due to the coupling of the counter electrode and the signal line, can be suppressed when the counter electrode potential is inverted, thereby reducing the consumption of power. Further, since the variation range of each signal line potential after the blanking period is small, the signal line can be promptly set at a desired potential.

For example, if the voltage of a display signal on a display signal bus varies within the amplitude of 1 to 4V as in the conventional case, all the potentials of the signal lines are fixed to the intermediate potential of the display signal during the horizontal blanking period in the embodiment. The intermediate potential means here a potential near the intermediate level of the maximum and minimum levels of the display signal, and is set at, for example, 2.5V in the above amplitude.

Since the signal line is thus fixed to the intermediate potential of 2.5V when the counter electrode potential Vcom is inverted, the variations in the potential of each signal line due to the coupling of the counter electrode and the signal line can be suppressed.

If black is displayed after fixing to the intermediate potential of 2.5V, the variation range of the signal line potential can be reduced to 1.5V, which is the difference between the intermediate potential of 2.5V and the potential used for displaying black in the negative polarity driving state, 1V. Thus, the signal line potential is prevented from being driven out of time, thereby suppressing variations in contrast and hence enhancing the quality of display.

A liquid crystal display device according to another embodiment of the invention will be described. In this liquid crystal display device, a desired potential is written during the horizontal blanking period via each analog switch ASWj of a signal line driving circuit to thereby fix a corresponding signal line potential.

Figure 3:
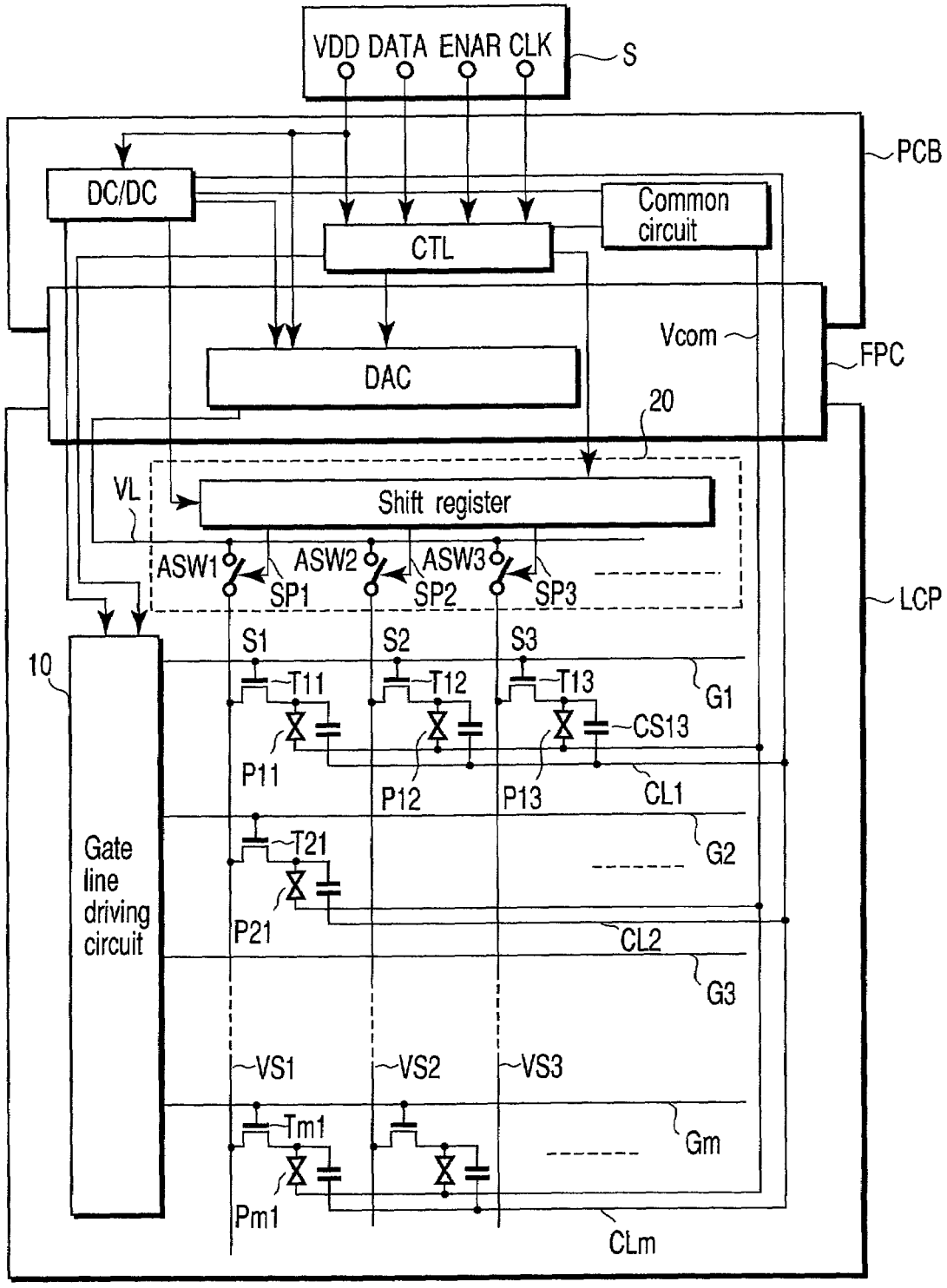
FIG. 3 is a schematic plan view illustrating the configuration of a liquid crystal display device according to another embodiment of the invention.
Figure 4:
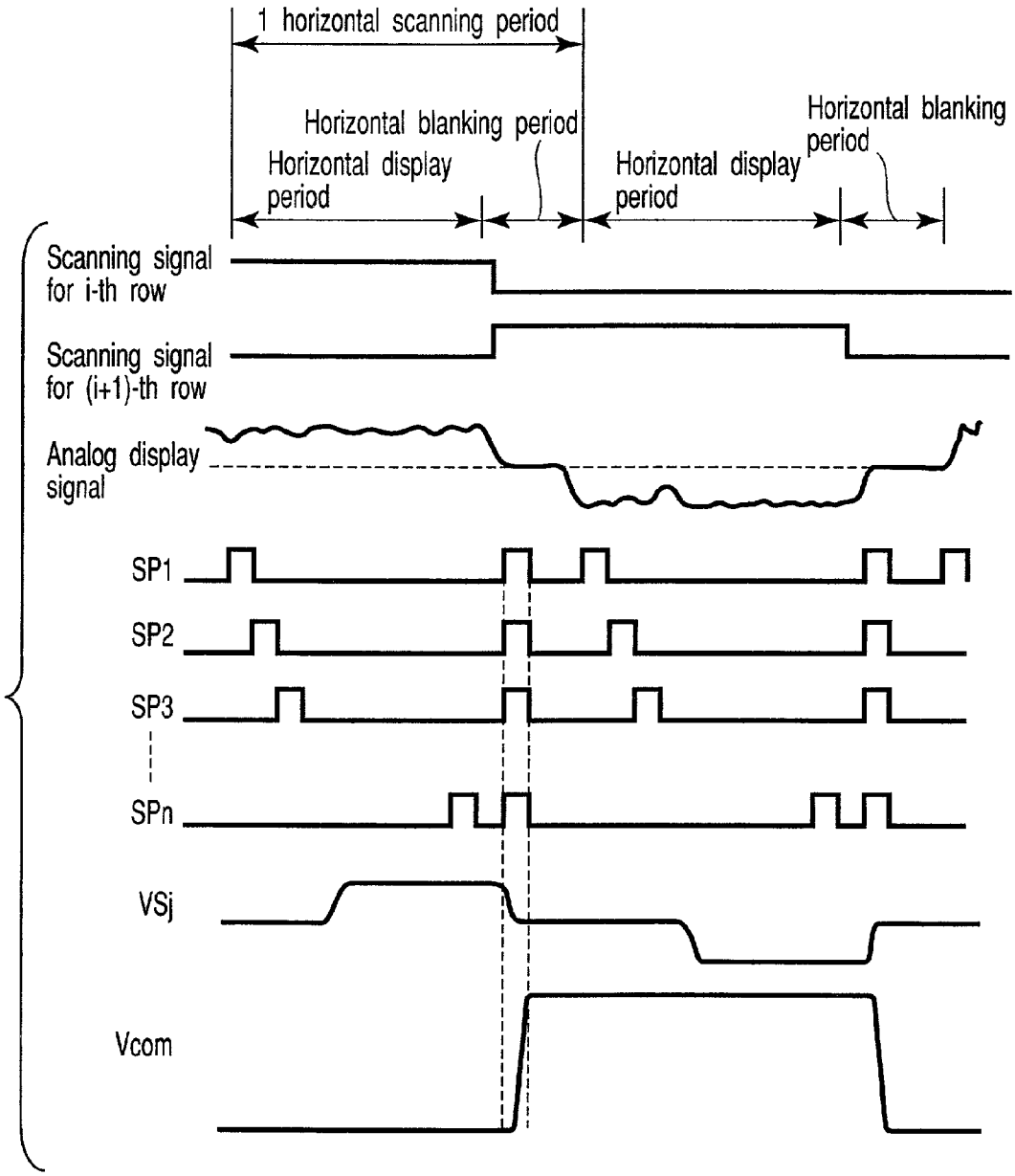
FIG. 4 is a timing chart for components of the liquid crystal display device shown in FIG. 3.

FIG. 3 is a schematic view illustrating the structure of the liquid crystal display device 1, and FIG. 4 is a timing chart illustrating the operation of the liquid crystal display device 1. In FIG. 4, an analog display signal, a shift pulse SPj input to each analog switch ASWj, a signal line potential for the j-th column, and the counter electrode potential Vcom are arranged from top down in a case where the H/common inversion driving method is performed with a use of one-point-at-a-time scanning.

As in the first embodiment, when a start pulse has been input at a certain timing, a necessary number of registers assigned to the signal lines sequentially output a shift pulse SPj obtained by shifting the start pulse in synchronism with a shift clock. The shift pulse SPj output from each register is input to the control terminal of a corresponding analog switch ASWj. When the shift pulse SPj has been input to the control terminal, the analog switch ASWj is turned on (closed), thereby supplying an analog display signal on the display signal bus VL to a corresponding signal line Sj. As the above operation is repeated, each analog switch ASWj is turned on substantially at the same time that the shift pulse SPj is output from a corresponding register, thereby supplying a corresponding analog signal on the display signal bus VL to a signal line Sj connected to the analog switch ASWj. As shown in FIG. 4, each signal line Sj holds a potential written immediately before the turn-off of a corresponding analog switch ASWj.

When one horizontal display period has finished and a horizontal blanking period has started, a shift pulse SPj for turning one each analog switch ASWj is input to all the analog switches, thereby writing the same signal to all the signal lines. While all the analog switches ASWj are in the ON state, each signal line potential is fixed to a desired potential, e.g. an intermediate potential. Further, in synchronism with this timing, the counter electrode potential Vcom is inverted with respect to that in the preceding horizontal display period.

After the horizontal blanking period finishes, a start pulse is input again and the registers of the shift register resume their shifting operations for the start pulse.

As described above, since all the signal lines are fixed to a desired potential, e.g. an intermediate potential in this embodiment, during the horizontal blanking period, variations in the potential of each signal line due to the coupling of the counter electrode and the signal line can be suppressed when the counter electrode potential is inverted, thereby reducing the consumption of power. Further, since the variation range of each signal line potential after the blanking period is small, the signal lines can be promptly set at a desired potential.

Figure 5:
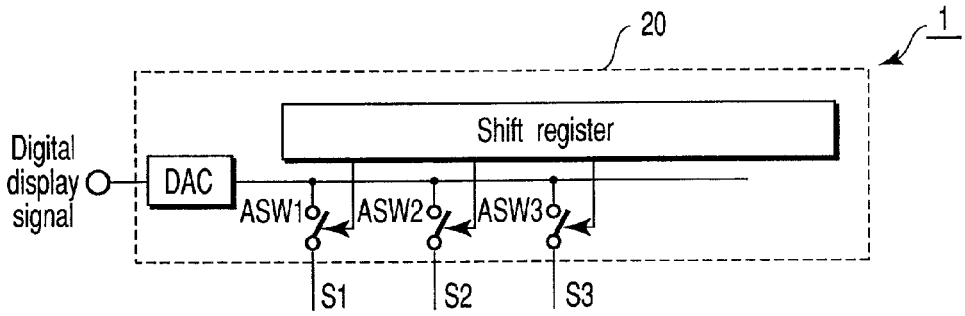
FIG. 5 is a view illustrating a first modification of a part incorporated in the liquid crystal display devices shown in FIGS. 1 and 3.

Although in the above embodiment, a description has been given of using a display signal of an analog form input to the array substrate, a digital signal input from the outside may be converted into an analog signal by the D/A converter provided on the array substrate, as shown in FIG. 5. The D/A converter DAC may be formed integral with the glass plate in the same process as the pixel TFTs of the display area or the driving circuit formed on the array substrate. Alternatively, the converter may be an IC chip, which is formed independently of the glass plate and provided thereon.

Figure 6:
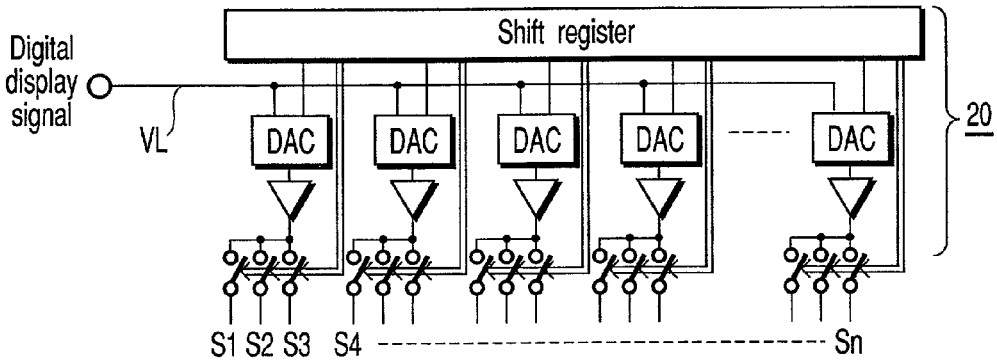
FIG. 6 is a view illustrating a second modification of the part incorporated in the liquid crystal display device shown in FIGS. 1 and 3.

Also, as shown in FIG. 6, the structure may be modified such that a digital display signal from the outside is subjected to serial-parallel conversion and then converted into an analog form by D/A converters DAC each of which is provided for a predetermined number of signal lines and distributes a result of conversion to the respective signal lines. Each D/A converter DAC is composed of polysilicon TFTs formed integral with the glass plate in the same process as the pixel TFTs of the display area.

In this case, each D/A converters DAC is connected to three signal lines forming a group for simultaneous selection and sequentially selects the three signal lines by time-division. In other words, the signal lines other than a selected one of the grouped signal lines are all in the floating state.

Thus, in the case where the D/A converter DAC is provided along with the signal lines on the same substrate, a display signal of a digital form can be supplied to the array substrate, and display of influence due to noise can be suppressed.

Figure 7:
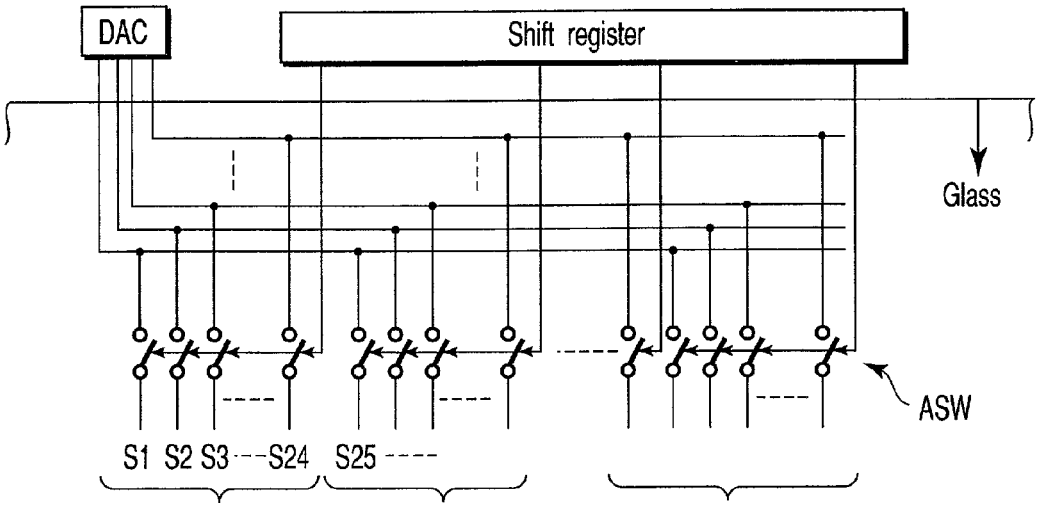
FIG. 7 is a view illustrating a third modification of the part incorporated in the liquid crystal display devices shown in FIGS. 1 and 3.

Furthermore, as shown in FIG. 7, the signal lines may be divided into groups each including a predetermined number of signal lines, and be driven in units of groups. In other words, the analog switches corresponding to the signal lines of a selected group are simultaneously turned on, while the signal lines of the other groups not selected are all in the floating state.

Thus, the one-point-at-a-time scanning does not always mean a system in which pixels are sequentially selected one by one at every horizontal line, but can include a time-divisional driving system in which a plurality of pixels simultaneously selected for one line are selectively driven during one horizontal scanning period. This time-divisional driving system may include a system in which signal line selection is executed in units of signal line groups, or a system in which all signal line groups are simultaneously selected, and the signal lines of each group are sequentially selected by time-division, as is described above.

Furthermore, as shown in FIG. 7, the analog switches ASWj, incorporated in the signal-line-driving circuit, may be formed on the glass plate alone, and other circuit elements, including the D/A converter, may be arranged externally. The number of outputs of the D/A converter DAC is identical to that of the signal lines belonging to all the signal line groups.

Figure 8:
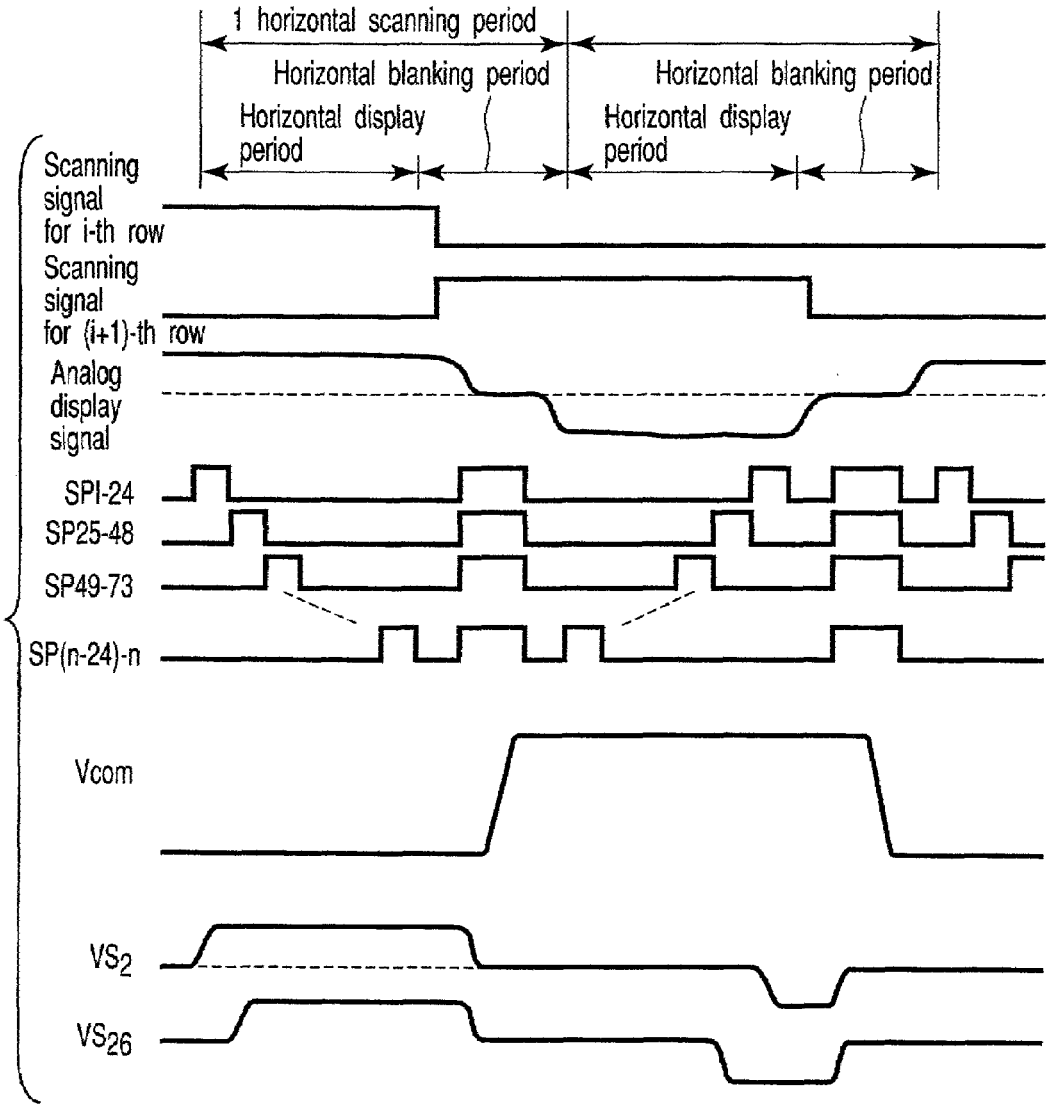
FIG. 8 is a timing chart illustrating the operation of the modification shown in FIG. 7.

FIG. 8 is a timing chart illustrating the operation of the liquid crystal display device of the structure shown in FIG. 7. In FIG. 8, a scanning signal for the i-th row, a scanning signal for the (i+1)-th row, an analog display signal on a display signal bus connected to an S-th column (S=2, 26, 50, . . . , n−22) signal line, a shift pulse SPj input to an analog switch ASWj of the j-th stage, the counter electrode potential Vcom, a potential VS2 applied to the 2nd signal line, and a potential VS26 applied to the 26-th signal line are arranged from top down. Thus, the writing order of a display signal in the signal lines may be reversed at every horizontal line. Although FIG. 8 shows that the writing order is reversed for every horizontal line, it may be reversed for every predetermined number of horizontal lines. Yet further, the writing order can be reversed in units of frames, in addition to the reverse in units of horizontal lines. This method of scanning enables variations in the potential of each storage capacitance line, if they occur, to be offset using the entire display screen, thereby realizing satisfactory image display.

Figure 9:
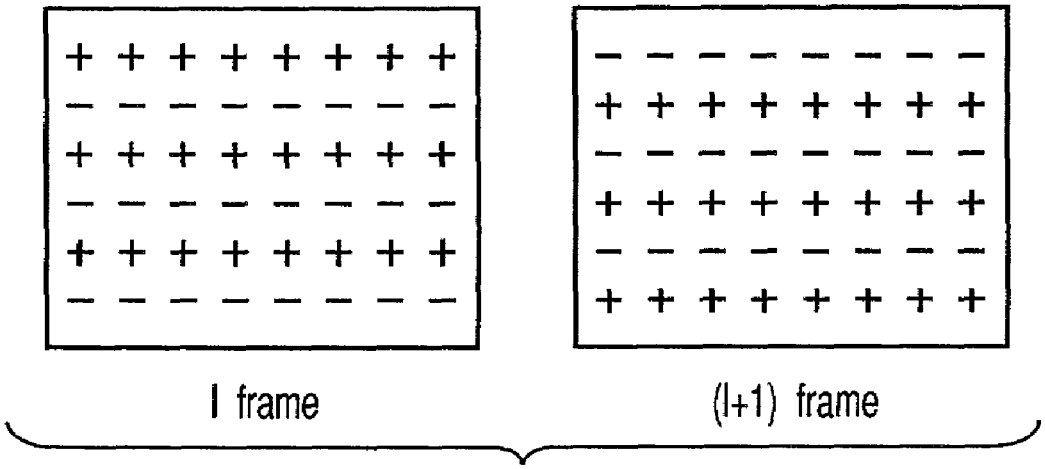
FIG. 9 is a view illustrating the polarity of each liquid crystal application voltage of the liquid crystal display device shown in FIGS. 1 and 3.
Figure 10:
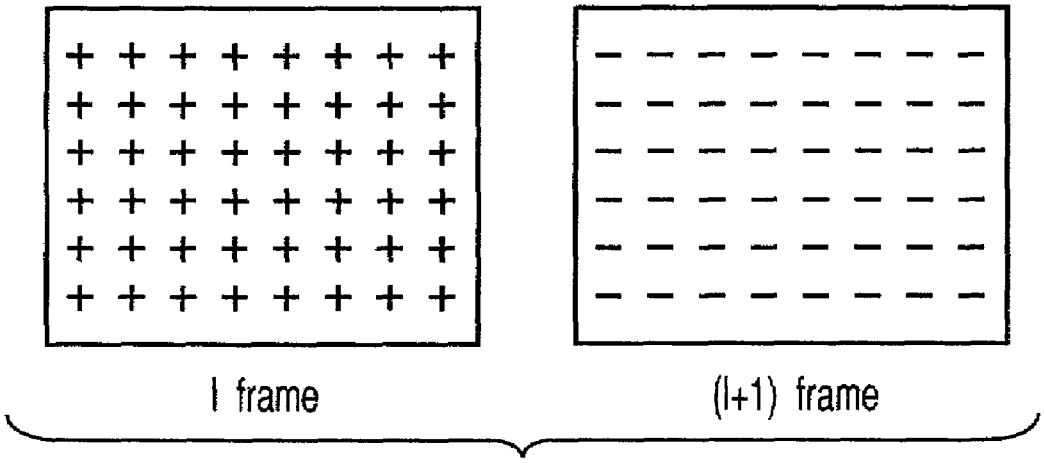
FIG. 10 is a view illustrating a modification concerning the polarity of each liquid crystal application voltage shown in FIG. 9.
Figure 11:
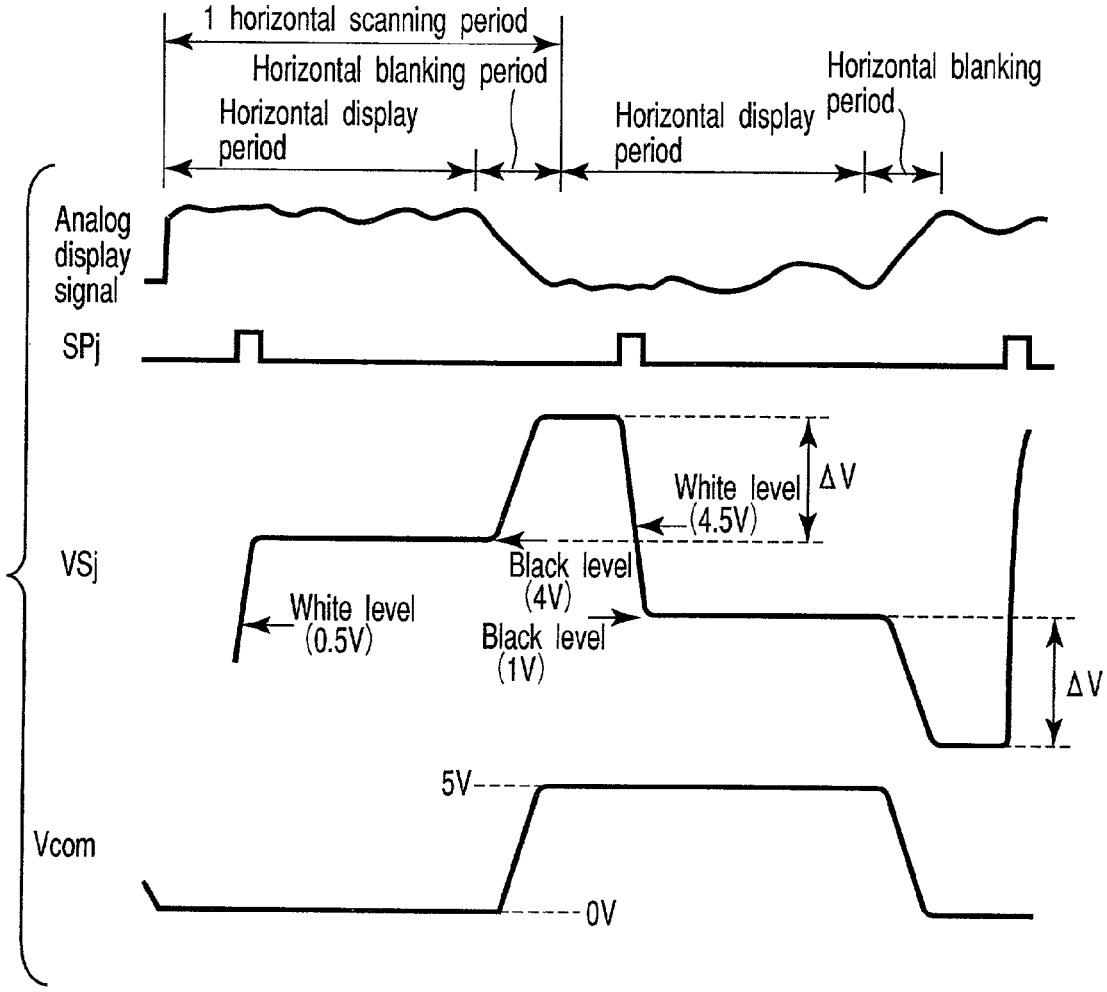
FIG. 11 is a timing chart for components of a conventional liquid crystal display device.

Moreover, the above-described embodiments explain that the counter electrode potential is inverted for every horizontal scanning period, as shown in FIG. 9, but the invention is not limited to this, and is also applicable to the H/common inversion driving method in which the counter electrode potential is switched for every predetermined number of horizontal scanning periods. For example, as shown in FIG. 10, in a frame inversion driving method, the counter electrode potential may be switched in units of frames. In this case, the period for wiring a display signal corresponding to one frame is set as a vertical display period, and the counter electrode potential is inverted during the vertical blanking period subsequent to the vertical display period. Thus, the present invention can be applied to various types of common inversion driving. This means that it is important to fix the signal line potential to a predetermined value when the counter electrode potential is inverted.

Furthermore, although each of the above embodiments uses a liquid crystal display device as an example, the invention is not limited to this, but is also applicable to various types of flat-panel display devices in which the common inversion driving is performed with a use of the one-point-at-a-time scanning.

In addition, in each of the above embodiments, a description has been given of a flat-panel display device in which a counter electrode is formed on one of two transparent insulation substrates, and pixel electrodes are formed on the other transparent insulation substrate. However, the invention is also applicable to an IPS (In Plane Switching) flat-panel display device, in which both the counter electrode and pixel electrodes are provided on the one substrate.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A driving method for a flat-panel display device which includes, on a substrate, a plurality of signal lines, a plurality of gate lines substantially perpendicular to said signal lines, a plurality of switching elements provided near intersections of said signal lines and said gate lines, a plurality of pixel electrodes connected via said switching elements, and a counter electrode opposed to said pixel electrodes, and a plurality of analog switches connected between a display signal bus and said signal lines for supplying a display signal to the signal lines, and in which the display signal is sequentially supplied to said signal lines and a potential of said counter electrode is inverted with respect to a reference potential for every predetermined number of horizontal and vertical scanning periods or for every predetermined number of vertical scanning periods so as to perform a display operation, said driving method comprising:

inverting the potential of said counter electrode during a horizontal or vertical blanking period subsequent to a horizontal or vertical display period; and fixing all the signal lines to a predetermined potential by simultaneously turning on said analog switches to supply a same signal from the display signal bus to all the signal lines, when the potential of the counter electrode is inverted.

2. A driving method according to claim 1, wherein the predetermined potential corresponds to an intermediate potential between maximum and minimum levels of the display signal.

3. A driving method according to claim 1, wherein the display signal is sequentially supplied to said signal lines during the horizontal display period.

4. A driving method according to claim 1, wherein said signal lines are divided into two or more groups, each group including a predetermined number of adjacent ones of said signal lines, and the display signal is sequentially supplied to each of the groups of said signal lines by time division during the horizontal display period.

5. A driving method according to claim 1, wherein said signal lines are divided into two or more groups, each group including a predetermined number of adjacent ones of said signal lines, and the display signal is simultaneously supplied to the groups of said signal lines during the horizontal display period, such that the display signal is sequentially supplied to said signal lines of each group by time division during the horizontal display period.

6. A driving method according to claim 1, wherein the display signal is supplied in a digital form, and converted into an analog form on the substrate.

* * * * *